United States Patent [19]

Grigsby

[11] Patent Number: 4,938,350

[45] Date of Patent: Jul. 3, 1990

[54] SHIPPING CONTAINER FOR AN OUTBOARD MOTOR

[75] Inventor: John M. Grigsby, Marietta, Ga.

[73] Assignee: North American Container Corporation, Mableton, Ga.

[21] Appl. No.: 220,802

[22] Filed: Jul. 18, 1988

Related U.S. Application Data

[63] Continuation-in-part of Ser. No. 126,659, Dec. 1, 1987, Pat. No. 4,792,041.

[51] Int. Cl.[5] ..... B65D 85/68

[52] U.S. Cl. ..... 206/319

[58] Field of Search ..... 206/319; 220/464, 468, 220/415; 248/640-643

[56] References Cited

U.S. PATENT DOCUMENTS

| | | | |
|---|---|---|---|
| 1,098,405 | 6/1914 | Reinecke . | |
| 2,249,270 | 7/1941 | Boeye | 206/319 |
| 2,316,854 | 4/1943 | George et al. . | |
| 2,475,135 | 7/1949 | Haven | 206/319 X |
| 2,488,692 | 11/1949 | Talbot . | |
| 2,515,428 | 7/1950 | Scott et al. . | |
| 2,596,320 | 5/1952 | Witte . | |
| 2,686,028 | 8/1954 | Johnson . | |
| 2,733,851 | 2/1956 | Van Ness | 206/319 X |
| 2,791,322 | 5/1957 | Boeye . | |
| 2,812,096 | 11/1957 | Muller . | |
| 2,817,436 | 12/1957 | Simpson | 206/319 X |
| 2,843,258 | 7/1958 | Boeye | 206/319 |
| 2,965,276 | 12/1960 | Foster . | |
| 3,006,462 | 10/1961 | Boeye et al. . | |
| 3,136,472 | 6/1964 | Waller et al. . | |
| 3,317,034 | 5/1967 | Bowles et al. . | |
| 3,601,251 | 8/1971 | Schwaner . | |
| 4,508,219 | 4/1985 | O'Neill | 206/319 |
| 4,756,413 | 7/1988 | Gits | 206/319 X |
| 4,792,041 | 12/1988 | Grigsby | 206/319 |

FOREIGN PATENT DOCUMENTS

| | | | |
|---|---|---|---|
| 83681 | 1/1920 | Switzerland . | |
| 427212 | 4/1935 | United Kingdom | 206/319 |

OTHER PUBLICATIONS

Wood-Cleated Corrugated by American Container Corporation (date unavailable).

Load Hog TM, V/Core TM by American Container Corporation (date unavailable).

*Primary Examiner*—William Price

*Attorney, Agent, or Firm*—Jones, Askew & Lunsford

[57] ABSTRACT

A wood cleated reinforced paper board shipping container for outboard motors including a bottom frame, a bottom box to enclose the powerhead end of the motor, a motor mounting frame, a gear case housing pad, an exhaust housing pad, and an upper box to enclose the gear case end of the motor, the motor rigidly mounted in the frame powerhead down in the container configured to protect the motor from damage while experiencing rough handling during shipping and warehousing of the motor, the motor mount frame having side rails, a front rail, a rear rail, a crossbar on which the motor mounts, the crossbar disposed normal between the side rails at an angle sufficient to orient a mounted motor at an angle with respect to verticle, and a strap around the front rail and crossbar resisting deformation of the crossbar to restrict rotation of the motor during shipping and handling.

25 Claims, 9 Drawing Sheets

SHIPPING CONTAINER FOR AN OUTBOARD MOTOR

This application is a continuation-in-part of the copending application for United States Letters Patent Serial Number 126,659 filed Dec. 1, 1987, now U.S. Pat. No. 4,792,041 issued Dec. 20, 1988, as U.S. Pat. No. 4,792,041.

TECHNICAL FIELD

The present invention relates to wood reinforced paper board shipping containers. More particularly, the present invention relates to wood reinforced corrugated paper board shipping containers for outboard motors to protect contained motors during shipping and handling and to permit stacking of motors and containers for storage.

BACKGROUND OF THE INVENTION

Manufactured products typically are shipped to purchasers in a container. The container protects the manufactured product from damage during handling and shipping. Containers also may be stacked for shipping and storage. Some items however are so large and heavy that the shipping container itself must have extra strength and weight to protect the enclosed product. One such product are large outboard motors in the four to eight cylinder size. Such motors are very heavy and may weigh up to eight hundred pounds or more.

Shipping of outboard motors from manufacturer to distributor or dealer presents difficult packaging problems. The problems arise because of the unusual shape of the motor and the distribution of weight in the motor. Typical outboard motors have the weight concentrated in the upper powerhead end of the motor. A relatively lightweight gear case extends longitudinally downward from the powerhead. The propellor connects to a drive shaft at the lower end of the gear case. A mounting bracket (or stern bracket) extending from the motor connects at an angle to the transom of a boat to position the motor vertically. Generally, the motor mounting bracket is located below the center of gravity of the motor. Known outboard motors swivel axially around the mounting bracket as well as tilt in the vertical plane.

The powerhead is typically enclosed in a fiberglass hood or cover. The cover typically has insufficient structural strength to serve as a bearing surface for any type of restraining or bracing members in the shipping package. The stern bracket however may be used to mount the motor in a shipping container.

A casting called an adaptor attaches the powerhead to the gear case. Generally, these castings are not sufficiently strong to withstand extremely rough handling that may be experienced during shipment. Shipping containers thus require some type of cushioning between the stern bracket and the container framework so that the motor can withstand shocks and pressures that occur if the packaged motor were knocked over or dropped from a forklift or clamp truck.

Other packaging considerations include the economic costs of transporting a number of packaged motors from the manufacturer to the distributors or dealers. Freight considerations make it desirable to keep the external dimensions of the container to a minimum. When transporting such large and bulky items, typical truckload maximum weights are almost never reached before the space in the truck trailer is filled. The shipper however is charged for the maximum amount if the trailer is full. A package which permits more containers to be loaded per truck lowers the average freight cost for shipping the motors.

In addition to the direct freight costs, other costs such as warehouse space and cost of the package itself, combine with truckload capacity, to offer practical reasons for attempting to minimize the external dimensions of the container. If it were not for these costs, the package could be made much larger for more cushioning and shock absorbing material to dampen shipping shocks and vibrations and restrict movement of the motor within the container in cases of extreme mishandling. Therefore the package must be designed to adequately cushion the motor and yet restrain internal movement within a practical package providing satisfactory protection against damage.

There are other economic reasons for packing outboard motors in sturdy shipping containers. Outboard motors for power boats may be quite expensive, and some of the larger, more powerful motors may cost more than ten thousand dollars. Shipping and handling damage may in some instances totally destroy a motor. Less serious damage to a motor, however, must be repaired before the motor may be sold or installed on a boat. The dealer or distributor receiving a damaged motor may have to wait a period of time to receive repair parts from the manufacturer. Also, the dealer or shipper incurs labor costs associated with replacing motor parts and repairing damaged motors. A container which protects a motor against shipping and handling damage may pay for itself in reduced costs associated with repairing damaged motors.

Generally it is known to mount a motor in one of two orientations for shipment in a container. First, a motor may be mounted in a horizontal position to a wood base and supported on the base by a crossbar attached to the stern bracket. A box or crate placed over the motor and attached to the base provides protection and stacking strength. A second known method is to ship the motor in a vertical position with the heavy powerhead end placed downward in a container with the gear case/-propellor end up to reduce the chance of accidental tipping of the motor.

This second known configuration offers several advantages in shipping. The motors typically are of such a size that when shipped in a vertical pack, more units per truckload is possible. This results in a lower freight cost per motor unit shipped. Also, the bigger motors are more easily and safely handled by lift truck or clamp truck and require less aisle space in handling. (A squeeze or clamp truck uses hydraulically operated plattens which exert pressure of sufficient force on the sides of the container to allow the container to be lifted by the truck for moving and stacking in the warehouse.) Clamp handling equipment is often preferred to forklifts as the package then does not require the external skid boards used with a forklift pack. Eliminating the need for skid boards further reduces the cost of the package and its vertical space requirements.

The horizontal packing containers generally require more aisle space, more warehouse space, and are more difficult to handle. For example, in the absence of a fork or clamp truck which may be used to pick up and move the crated motor, it is easier to walk or manhandle a vertical pack with a relatively small area of contact with the floor than a horizontal pack where the contact area is greater. It is generally desirable that a package not only protect the motor unit during shipping, but the package itself should have sufficient topload or stacking strength to allow containers with motors to be stacked in a warehouse up to five or more units high with safety. This normally requires that the container be capable of supporting the weight of four units stacked on top. Also, a normal industry safety factor is a multiple of four times the estimated load on the bottom box in a stack.

The preferred packaging for outboard motor shipping containers requires sufficient bottom strength to withstand forklift handling while protecting the relatively weak powerhead cover. The package also requires sufficient side-to-side strength to allow handling by these squeeze or clamp trucks. Thus, the package rigidity contributes to protecting the motor, but the motor also needs cushioning to dampen vibrations or shocks to the package during handling and shipping.

Generally, many outboard motor manufacturers require a shipping container to pass a series of simulated rough handling tests before the container is approved for use in shipping. The motor is placed in the container for which approval is sought and the container is then subjected to the tests. These tests usually include dropping the container from various heights to simulate manhandling and dropping from the back of a truck; tipping the package over first with the powerhead up and then with the powerhead down to simulate accidental tipping when handling either manually or with equipment; and prolonged vibration to simulate the jostling or shaking encountered during many miles of truck or rail shipment. It is contemplated that the container of the present invention provides an outboard motor shipping container which is capable of meeting these stringent tests.

A preferred motor package is simple and relatively easy to assemble on a production line. Such simplicity and ease of assembly minimizes the labor cost involved in packaging the outboard motors for shipment. It is desirable to have few component parts and preferably the outer cartons or side wall components of the packaging collapse flat for shipment from the container manufacturer to the motor manufacturer. Thus the packaging itself preferably requires a minimum of freight costs to transport the shipping package components to the motor manufacturer, and when at the plant, requires a minimum of warehouse storage space.

The known packages previously used to ship such large outboard motors in a vertical, powerhead down configuration have not met with satisfactory results. If no material handling equipment such as a clamp or forklift truck is available, the package must be manhandled in and out of delivery trucks and around warehouses. Often this involves manhandling the package over a vertical distance between the truck and the warehouse floor. This distance may be of 48 inches or more, and sometimes the heavy motors are dropped. Thus the package requires great strength to insure side wall integrity yet provide sufficient cushioning to prevent breaking the adaptor casting or other parts not designed to take such extreme shock. The cushioning however cannot be so great as to allow the motor and motor cover to touch the inside walls of the package in the event the package is pushed over or dropped. Thus the packaging must provide sufficient shock absorbing cushioning so the motor parts will not break, yet provide sufficient restraint so the motor will not move beyond the bounds of the inside dimensions of the container when subject to such extremes in handling.

Some small motors—five or eight horsepower, for example—have been successfully packaged in styrofoam with the motor cover serving as the bearing surface for the powerhead end. In such cases, the motor cover is sufficiently strong with respect to the relatively light weight of the engine to be used safely as a bearing surface of packaging. For the much heavier, larger outboard motors such styrofoam packaging is not satisfactory. As explained previously, known packaging used to ship the large outboard motors mount the motor in a vertical, powerhead down configuration. In general, these packs have combined a standard corrugated paper board outer box with many die-cut corrugated folded and scored inner packing sheets to provide stacking strength, support for restraining movement, and side wall strength for handling by clamp trucks. One known package employs a wood board which inserts into plastic mounts or caps glued to a multi-scored corrugated pad. This forms a crossbar to which the motor may be bolted through its stern mounting bracket. This pack, however, requires over seventeen different scored corrugated sheets, and it is difficult to assemble the pack on a packing line. The many parts contribute to inventory storage and control problems, and smaller motors require different sized components than those used with larger motors. In addition, corrugated board may lose up to 50% of its stiffness and compression strength in conditions of high heat and humidity, thus making long term warehouse stacking of corrugated packages unsafe.

U.S. Pat. No. 3,136,472 issued to P. H. Waller et al. describes a container framing for shipping outboard motors in a vertical position. A wood frame is constructed around the motor, and a corrugated or solid fiber outer box is placed over this crate. No shock absorbing features are built into the wood framework and the framework does not include internal restraining pads to support the gear case and exhaust housing. The crossbar is a loose member designed for clamping onto a small motor with the side frameworks to be then placed onto the crossbar.

The Waller pack, however, cannot be unitary because if the wood framing were attached to the corrugated box, then it would be more difficult, if not impossible, to install the motor in the container. Nor could such a container fold flat, or knock-down, for more compact storage. Generally, it may be considered mandatory for a commercially produced production pack to knock-down. Without providing for padding for the gear case or exhaust housing, it is unlikely the Waller pack would pass a manufacturer's manhandling test. The motor would be free to swing about the crossbar and contact the warehouse floor in both a vertical drop and tipover. Wooden framing, lacking shock absorbing material, would transmit shock and vibrations to the motor and to the crate structure, and lead to motor damage and container damage. Significant container or frame damage may itself lead to additional motor damage. Also, the Waller packing requires a crate be assembled around the motor and then encased in a box. This is a significant assembly operation in and of itself and contributes to increased indirect costs associated with the motors.

SUMMARY OF THE INVENTION

The present invention provides a shipping and storage container which overcomes the problems found in prior packaging for outboard motors. In particular, the container of the present invention combines a rigid structure to provide container wall integrity with sufficient cushioning materials to absorb vibrations and shock which arise from handling and shipping outboard motors. Further, the present invention holds the motor at a predetermined angle with respect to a true vertical orientation to attain a minimum cube for the package. Because the stern bracket generally mounts at an angle with respect to the transom of a boat to position the motor vertical, the present invention provides an angled motor mount to increase the extent of the motor angle off vertical. Such angled positioning of the motor minimizes the cubic space required for the container, because the pack may then be smaller front to back. Such angled mounting also provides shock absorbing properties because the motor mount crossbar will flex more as its orientation becomes less vertical. Such a container will require less warehouse and truck space. Handling, whether done by forklift, clamp truck, or by hand, is easier with a smaller package. The internal bottom wood frame of the present invention contributes to the structural integrity of the container but also permits use of forklifts for handling the container without requiring external skid board assemblies.

In addition to the strength and cushioning provided by the present invention to protect the contained motor, the container provides economic advantages as well. The strong container reduces the dealer repair costs for parts and labor to repair motors damaged during shipment or warehousing. The container of the present invention requires fewer component parts than many containers previously used. Fewer component parts reduces the warehouse storage requirements for the motor manufacturer and leads to reduced inventory and control problems. The present invention provides simple production line assembly for packaging of the assembled motors. Larger elements of the container of the present invention also may be shipped and stored in a knockdown position. The element may then be readily squared open when used in the production line to package a motor.

The shipping package of the present invention provides a bottom frame which may be engaged by forks of a forklift tractor to hoist and move the motor and container. The bottom frame mounts at the lower end of the bottom box which, in a preferred embodiment, is a double wall corrugated box having wood cleats attached to the interior. The wood cleats mount vertically at the corners and on two sides of the box. A motor frame mounts to the upper end of bottom box. The motor frame includes an angled crossbar which attaches rigidly to the side rails of the motor frame. A gear case pad, which installs in the container over the motor frame, has two wings depending from the bottom surface of the gear case pad. The distal end of each wing rigidly connects adjacent a side rail of the motor frame. The gear case of the motor extends through a slotted opening in the gear case pad. An upper gear case support pad connects to the upper side of the gear case pad to restrain the gear case from rotating out of the slot. An alternate embodiment employs a strap tightly positioned around the crossbar and a front rail of the motor frame instead of using the upper gear case support pad. The crossbar/front rail strap restricts twisting or rotating of the crossbar, which in turn, restrains rotation of the motor out of the slot.

An exhaust housing pad is supported by the motor frame and angles upwardly towards the gear case pad to support the exhaust housing of the outboard motor. An alternate embodiment replaces the exhaust housing pad with a strap which attaches to the crossbar and wraps around the gear case housing of the motor.

A paperboard top box having interior wooden corner and side cleats slides over the gear case pad and rigidly connects to the motor frame. Various motor parts accessories including the battery cable, the steering bracket, the tilt, trim and gauge assemblies, and other parts, may be boxed and inserted into the top box of the shipping container. These smaller boxed parts rest on the upper surface of the gear case pad and nestle around the gear case of the outboard motor.

The structure of the present invention overcomes the limitations of containers previously used for shipping outboard motors. The corner and side cleats in the bottom and top boxes provide sidewall integrity to the container which may be handled by forklift or clamp truck equipment, as well as manhandled. The cleats also transfer the load of the motor, or the load of stacked containers, to the motor frame and the bottom frame. In addition, the wood cleats provide stacking strength for warehouse storage, and the strength will not decrease in conditions of high heat and humidity. This enables the packaged motor to be stacked higher and for longer periods with a much greater degree of safety than is possible with containers that depend on corrugated paper board for stacking strength.

The gear case pad, together with an upper gear case support pad, restrict the motor from pivoting around the crossbar of the motor frame. The gear case pad also cooperates with the exhaust housing pad to restrict the motor from swiveling in the motor frame. Similarly, the crossbar/front rail strap in an alternate embodiment also functions to restrict the motor from pivoting by reducing the tendency of the crossbar to deform when the container is dropped or tipped over. The gear case strap in an alternate embodiment replaces the exhaust housing pad and restricts the motor from lateral swiveling and from pivoting around the motor frame.

Layered component construction and resilient padding contribute cushioning features to the container to absorb shipping vibrations and shocks. Thus the container meets the container requirements for great strength yet provides sufficient cushioning to keep the powerhead from breaking the adaptor casting or other parts not designed to take such extreme shock as may be experienced during a drop or pushover type of fall.

BRIEF DESCRIPTION OF THE DRAWINGS

Objects and advantages of the present invention will become further apparent upon reading the following detailed description and upon reference to the following drawings, in which like elements have like identifiers.

DETAILED DESCRIPTION OF THE PREFERRED EMBODIMENTS

The present invention provides a wood-reinforced corrugated paper board container for shipment and warehouse storage of outboard motors. The motor mounts powerhead down to a frame medial the longitudinal ends of the container and is protected from damage which may be caused by shipping, storing, and handling.

Figure 1:
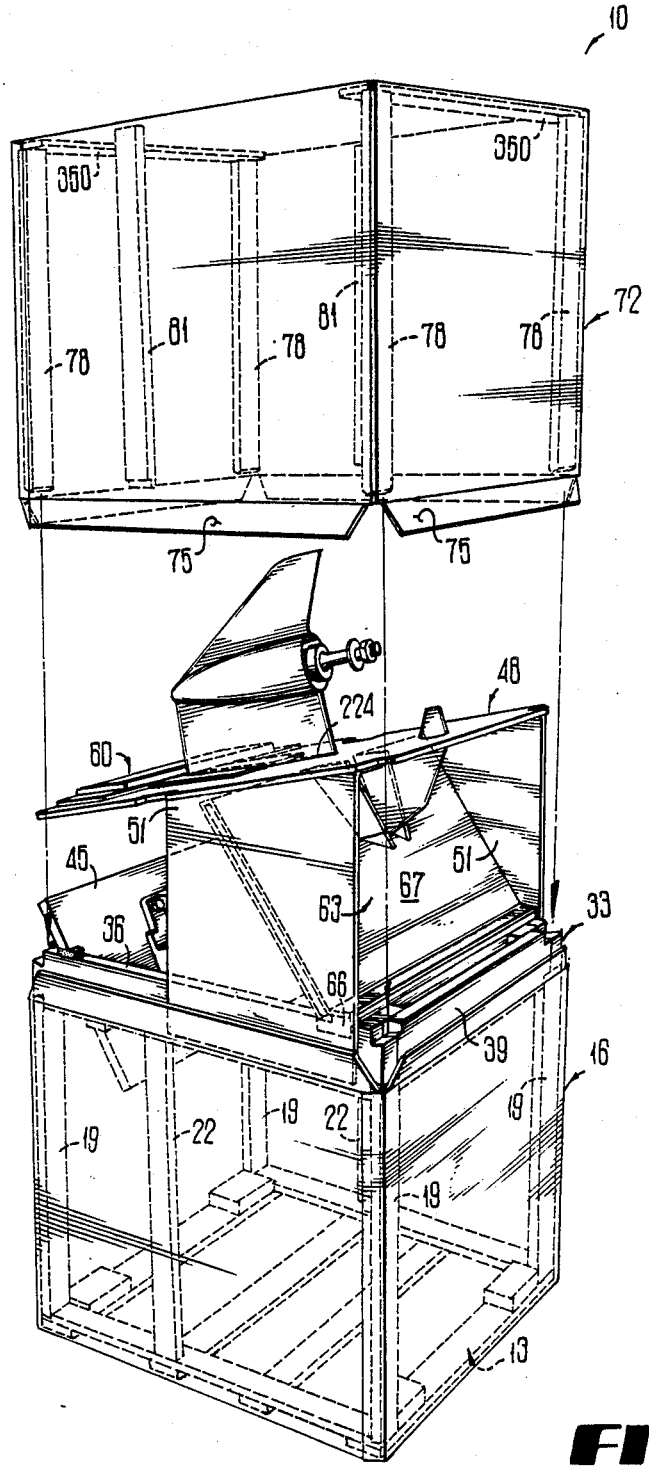
FIG. 1 is a cut-away perspective illustration of an outboard motor shipping container according to the present invention, with the top box exploded from the container.

Turning now to FIG. 1, there is illustrated a perspective view of an outboard motor shipping container 10 according to the present invention. The container 10 includes a bottom frame 13 which mounts to the lower end of a bottom box 16. Rigidly connected to the interior of the bottom box 16 are a plurality of corner cleats 19 and side cleats 22. A short connector flange extends upwardly from each side of the upper end of the bottom box 16. A pair of inner flaps 28 (better illustrated in FIG. 5) foldably connect to the lower end of the bottom box 16. The inner flaps 28 are on laterally opposite sides of the bottom box 16. Adjacent the inner flaps 28 are a pair of outer flaps 31 (better illustrated in FIG. 5) also located at the lower end of the bottom box 16. A motor frame 33 connects to the upper end of the bottom box 16. The motor frame 33 includes two side rails 36, a back rail 39, a front rail 42 (not illustrated) and a crossbar 45. The crossbar 45 attaches at an angle to the motor frame 33 and the motor connects rigidly to the crossbar 45.

A gear case pad 48 includes a pair of wings 51 which connect to and extend downwardly from the bottom surface of the gear case pad 48. The horizontal surface of the pad 48 rests on the cavitation plate of the contained motor. The lower edge of a wing 51 attaches with staples to one of the side rails 36 of the motor frame 33. A slot is cut medial the lateral ends of the pad 48 from the front edge of the pad 48 toward the middle of the pad 48. The length and width of the slot depends on the width of the gear case and the angle of the motor orientation in the container 10. An upper gear case support pad 60 mounts to the upper surface of the pad 48 adjacent its front edge.

An exhaust housing pad 63 is disposed between the back surface of the pad 48 and the upper surface of the motor frame 33. The exhaust housing pad 63 includes a lower support member 66 and a composite laminated pad 67. The support member 66 fixedly connects to the side rails 36 of the motor frame 33.

A top box 72 encloses the upper portion of the container 10. The top box 72 slips over the gear case pad 48 adjacent the motor frame 33. The top box 72, like the bottom box 16, is a half slotted style box, and includes a short connector flange extending from the bottom edge of each side. These connector flanges at the lower end of the top box 72 provide a staple portion 75 which overlap the bottom box connector flanges adjacent the motor frame 33. The top box 72 also includes corner cleats 78 and side cleats 81. These cleats 78 and 81 are rigidly connected to the interior walls of the top box 72. Foldably connected to the upper edges of the sides of the top box 72 are a pair of inner flaps 84 and outer flaps 86 (better illustrated in FIG. 10). These flaps may be folded over, glued and stapled, to cover the top of the container 10.

Figure 2:
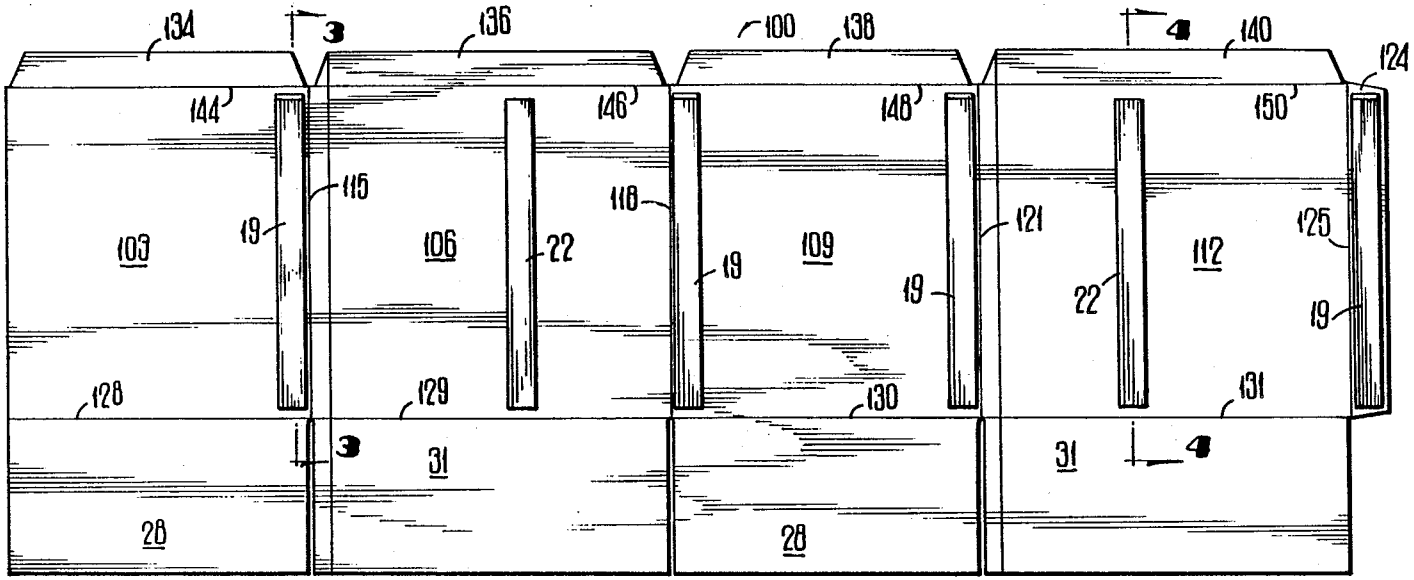
FIG. 2 is a top plan view of a bottom box blank according to the present invention which, when assembled, encloses the motor as illustrated in FIG. 1.

The bottom box 16 of the present invention is preferably formed from a blank of corrugated paper board material. FIG. 2 is a top plan inside view of the bottom box 16 blank which, when assembled, encloses the motor powerhead. The bottom box blank 100 includes four main panels, 103, 106, 109 and 112, foldably connected along score lines 115, 118 and 121. The four main panels 103, 106, 109 and 112 form the four side walls of the container 16 illustrated in FIG. 1. A joint tab 124 extends along a score line 125 from the side of the panel 112. The two sets of paired bottom flaps 28 and 31 foldably connect to the panels 103, 106, 109 and 112 along a score line 128, 129, 130 and 131 respectively. A corner cleat 19 rigidly connects with glue and staples to the edge of each panel 103, 106, 109 and 112 along the score lines 115, 118, 121 and 125. The panels 106 and 112 each include a side cleat 22. Each of the corner cleats 19 and side cleats 22 are preferably glued and stapled to the corrugated box surface. The upper flanges 134, 136, 138 and 140 foldably connect along a score line 144, 146, 148 and 150 to the panels 103, 106, 109 and 112, respectively. (The flanges 134, 136, 138 and 140 are preferably crushed to reduce wall bulk when the flanges 134, 136, 138 and 140 overlap and connect to the flanges depending from the upper box 72.)

The weight and the strength of the corrugation for the box 16 is preferably sufficient to hold the wood cleats 19 and 22 in place under the stresses of torque which arise during handling and shipping. It is contemplated that the wood cleats 19 and 22 carry most of the top load and motor frame/outboard motor load, but the corrugated paper board material must be strong enough to act as a diagonal cross-bracing to prevent sideways collapse of the wood cleat verticals 19 and 22 in stacked shipment when the upper loaded containers, reacting to the motion and the stopping and starting of the railroad car or truck, torque and twist the lower containers. In a preferred embodiment, a heavy double wall corrugated paper board material capable of up to 500 pounds bursting strength is used, but this weight and strength depends on the size and weight of the outboard motor being shipped. An alternate embodiment uses a corrugated paper board manufactured with reinforcing nylon or other plastic filament tape to prevent tearing.

Figure 3:
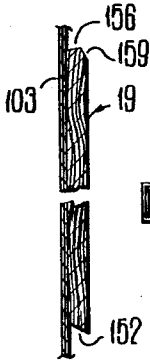
FIG. 3 is a cross section view of the corner cleat attached to the inner wall of the bottom box illustrated in FIG. 2 and taken along lines 3—3 of FIG. 2.

The primary load bearing members of the bottom box 16 are the four vertical corner cleats 19. The side cleats 22 also carry load and reduce the span of the side rail 36. In a preferred embodiment, the cleats used in the present invention are made from a hardwood. FIG. 3 is a cross-section view of the corner cleat 19 taken along lines 3—3 of FIG. 2. The bottom end 152 of the cleat 19 is beveled, and in a preferred embodiment, forms a bevel angle of about 24 degrees upward with respect to the horizontal. It is contemplated that this bevel angle may be different than the preferred angle, but a bevel which is too shallow may permit the cleats 19 to slip off of the bottom frame 13 or if too steep, may shear the bottom frame 13 where it meets the cleat 19. It is contemplated that the bevel angle may range from about 5 degrees to about 30 degrees. The upper end 156 of the cleat 19 is also beveled to form preferably about a 7 degree angle downward with respect to the horizontal. It is contemplated that this upper bevel may range from about 5 degrees to about 15 degrees. Again, the angle of this upper bevel is not to be construed as the only possible angle; and angle which is too shallow may permit the cleat to slip from its connection with the motor frame 33, while an angle too steep may split the cleat or the motor frame 33. A slight taper or ease 159 is formed in the upper end 156 of the cleat 19.

Figure 4:
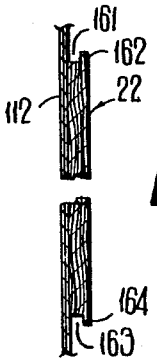
FIG. 4 is a cross section view of the side cleat of the bottom box illustrated in FIG. 2, taken along lines 4—4 of FIG. 2.

FIG. 4 is a cross-section view of a side cleat 22 taken along lines 4—4 of FIG. 2. The ends 161 and 163 of each side cleat 22 are notched to define longitudinally extending legs 162 and 164.

Figure 5:
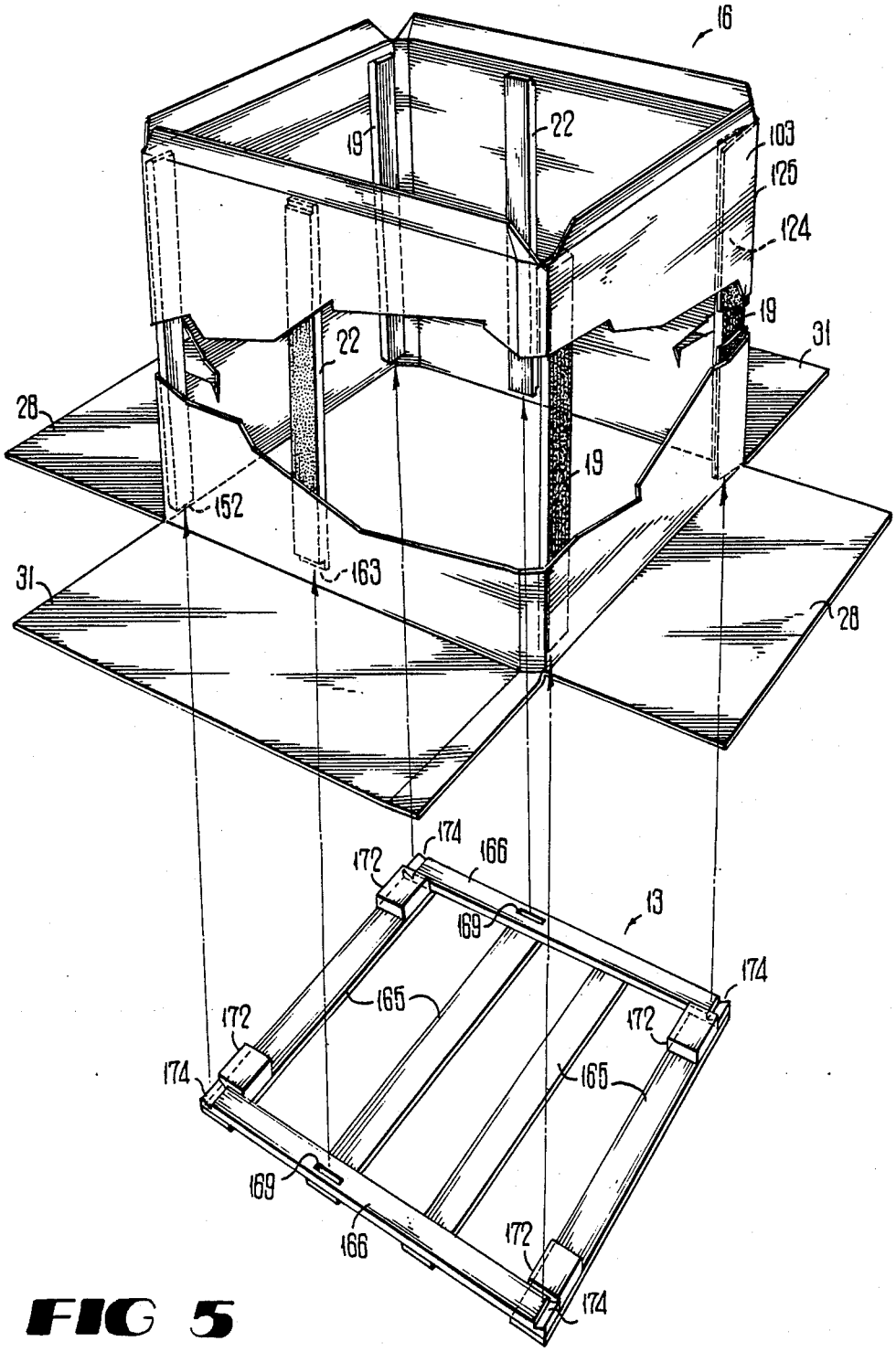
FIG. 5 is a perspective view of the bottom frame of the outboard motor shipping container, exploded from the bottom box which is shown in a cut-away perspective view.

FIG. 5 illustrates a perspective view of the bottom frame 13 of the container 10 of the present invention. The bottom frame 13 is shown exploded from the bottom box 16 to which the frame 13 connects. The frame 13 in a preferred embodiment for larger size motors includes four transverse members 165. The inner pair of transverse members 165 protect the fiberglass cover on the motor when the container 10 is handled by a forklift truck. A container for a smaller motor may use a fewer number of transverse members 165 and still provide sufficient stability and protection of the motor. A pair of longitudinal members 166 connect to the ends of the support members 165. In a preferred embodiment, the members 165 and 166 are wood. A mortise 169 is formed in the upper surface of each of the longitudinal members 166. The mortise 169 receives the notch leg 164 of the bottom box side cleat 22 as illustrated in phantom on the exploded box 16 of FIG. 5. A support block 172 connects on the upper face of each end of support member 165 adjacent the longitudinal member 166. As illustrated, four such support blocks 172 are used in the frame 13, with one such block 172 located adjacent each of the exterior corners. These blocks 172 also prevent the corner cleats 19 of the bottom box 16 from being forced inward by pressure exerted on the side of the container 10 by the plattens of a clamp truck.

As illustrated in FIG. 5, the ends of the longitudinal members 166 have a bevel notch 174 of about 24 degrees to match the bottom bevel 152 of the corner cleat 19. The joint tab 124 folds along the score line 125 to lap inside the side panel 103. In a preferred embodiment, the joint tab 124 is rigidly glued with an appropriate adhesive to form an integral connection with the side panel 103. The corner cleat 19 attached the joint tab 124 is thus located at the inside corner of the box 16.

Figure 6:
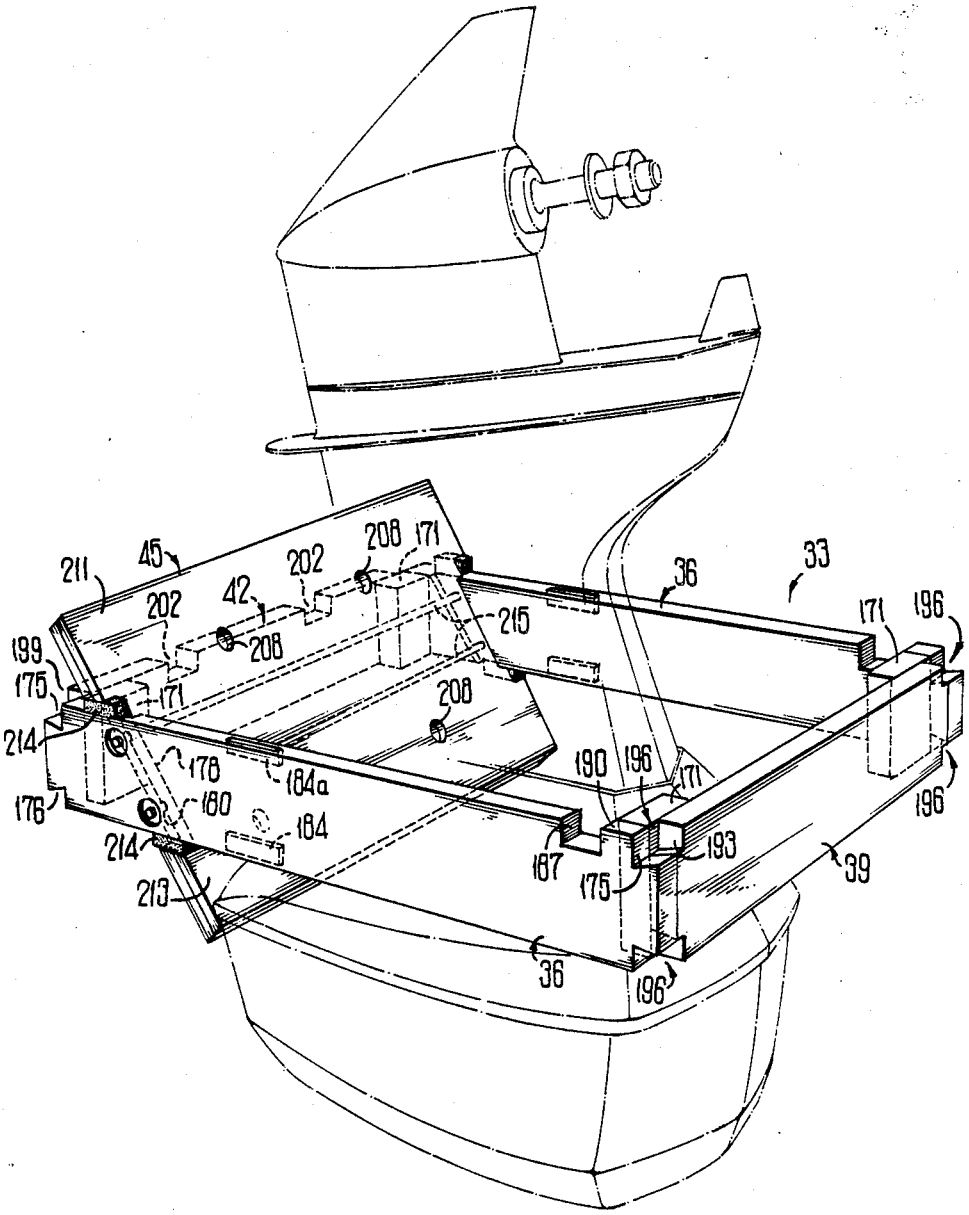
FIG. 6 is a perspective view of a motor frame according to the present invention with an outboard motor illustrated in phantom as mounted on the crossbar of the motor frame.

A perspective view of a motor frame 33 according to the present invention is illustrated in FIG. 6 with a mounted motor illustrated in phantom. The motor frame 33 includes the two side rails 36, the back rail 39, the front rail 42 illustrated in phantom, and the crossbar 45. The side rails 36, the front rail 42, and the back rail 39, together with the crossbar 45, are connected together at their ends to form the enclosed rectangular motor frame 33. A plurality of corner blocks 171 connect to the front rail 42 and back rail 39 adjacent the interior corners defined by the connection of the rails 42 and 39 with the side rails 36. In a preferred embodiment, the rails for the motor frame are manufactured from a hardwood such as white ash, hickory, or white oak.

Considering first the side rails 36, the upper end corners 175 and lower end corners 176 of the rail 36 are notched. The inner surface of the side rail 36 has a groove 178 angling from the bottom to the top surface of the rail at about 25 degrees from the vertical. The crossbar 45 connects in the angled groove 178 to the side rails 36. This angle of 25 degrees is appropriate for many motors, which as discussed above, have an angled motor mount. Generally, the motor mount angle is about 12 degrees and positions the motor vertically with respect to the longitudinal axis of the boat. The pack of the present invention thus increases the angle at which the motor is supported to minimize the package necessary to hold the motor. For other motors, the crossbar angle may vary, depending on the geometry of the motor mount and how much additional mounting tilt is necessary to minimize the pack dimensions and still permit the pack to pass the simulated shipping and handling tests.

The depth of the groove 178 is about one fourth to about one third the thickness of the side rail 36. The depth of the groove 178 preferably provides a lip sufficient to keep the crossbar from rotating. If the groove 178 is too deep, the side rail 36 is weakened. The groove 178 contains two bores 180 perpendicular to the longitudinal axis of a rail 36. In a preferred embodiment, the bores 180 are countersunk on the exterior side of the rail 36. The upper and lower rail surfaces 36 each include a mortise 184 and **184*a*. The lower mortise 184 defines a pocket which receives the leg 162 of the side cleat 22 of the bottom box 16. (The upper mortise 184*a* receives the leg 342 of the side cleat 81 of the top box 72, discussed below.) The upper edge of the side rail 36 includes a notch 187 offset from the rear end of the side rail 36. The notch 187 defines a stop 190 adjacent the notch 175 in the rear corner end of the rail 36**.

The transverse rear rail 39 includes notches 193 in the corner ends of the rail 39. The notches 193 cooperate with the notches 175 and 176 of the side rails 36 to define pockets 196. The surface of the notch 193 preferably defines an angle of about 7 degrees with the horizontal to match that beveled angle in the adjacent side rail notches 175 and 176. The front rail 42 illustrated in phantom similarly has beveled corner notches 199. The notches 199 cooperate with the notches 175 and 176 of the side rail 36 to define pockets which engage the corner cleats 19 of the bottom box 16 and the corner cleats 78 of the top box 72. The front rail 42 also includes a pair of slots 202 in the upper edge. In the illustrated embodiment, the slots 202 are rectangular cutouts from the rail 42. The slots 202 in an alternate embodiment are U-shaped cutouts. Depending on the top-to-bottom location of the motor bolts, the slots 202 may be replaced with bores, because slots cut too deep weaken the front rail 42. The slots 202 (or bores) are sized to permit free passage of the socket of a power wrench.

Also illustrated in FIG. 6 is a perspective view of the crossbar 45 of the motor frame 33. Four motor mounting holes 208 are drilled in the crossbar of a diameter sized appropriately to receive rubber bushings. The mounting bolts extending from the outboard motor pass through the rubber bushings which have a wall thickness sufficient to provide shock relief or cushioning between the motor mount and the crossbar 45. The lateral sides of the crossbar 45 extend outwardly to define an upper lip 211 and a lower lip 213. The interior sides of the lips 211 and 213 adjacent the upper and lower surfaces of the rail 36 are beveled at an angle to match the crossbar mounting angle of the side rail groove 178. In a preferred embodiment, this is about 25 degrees. As discussed above, the crossbar mounting angle is determined by the particular geometry of the stern bracket of a motor to be packaged in the container 10, as well as the desired tilt of the motor to obtain minimum package dimensions. Placed between the interior sides of the lips 211 and 213 are flexible bushings 214. These bushings 214 may be rubber, or some other resilient material, to provide shock relief between the crossbar 45 and the motor frame 33. The combination of these bushings 214, plus the bushings in the mounting holes 208 on the crossbar 45, effectively cushion the motor with respect to the rigid motor frame 33.

Illustrated in phantom is a pair of slots 215 spaced approximately equa-distant above and below the longitudinal axis of the crossbar 45. The slots 215 are of a size to permit insertion of a threaded steel rod. A preferred embodiment of the crossbar 45 laminates two pieces of three-quarter inch plywood C—C or equivalent exterior grade to form the crossbar 45. The slots 215 may then be cut as a groove in the mating surfaces of the pieces which form the crossbar 45, instead of drilling the slots 215 parallel to the longitudinal axis in the narrow crossbar 45.

In a preferred embodiment, two rods rigidly connect the crossbar 45 and side rails 36. Thus, the crossbar 45 angularly mounts in the motor frame 33 to provide additional rigidity and strength to the frame, with threaded rods which pass through the bores 180 and the slots 215. It is contemplated that a container 10 for a smaller lighter motor may eliminate the rods because nailing the grooves, lips, and joints together may prove satisfactory. Eliminating the rods, washers and nuts would reduce the cost of the container. Also, the thickness of each layer of plywood in the crossbar 45 is a function of the size and weight of the motor. In some instances, a much lighter motor such as a 2 or 3 cylinder motor may not require a laminated crossbar; a single sheet of plywood may prove to be adequate and less costly. For embodiments without the laminated crossbar 45, the threaded rods and nuts may be eliminated.

Figure 7:
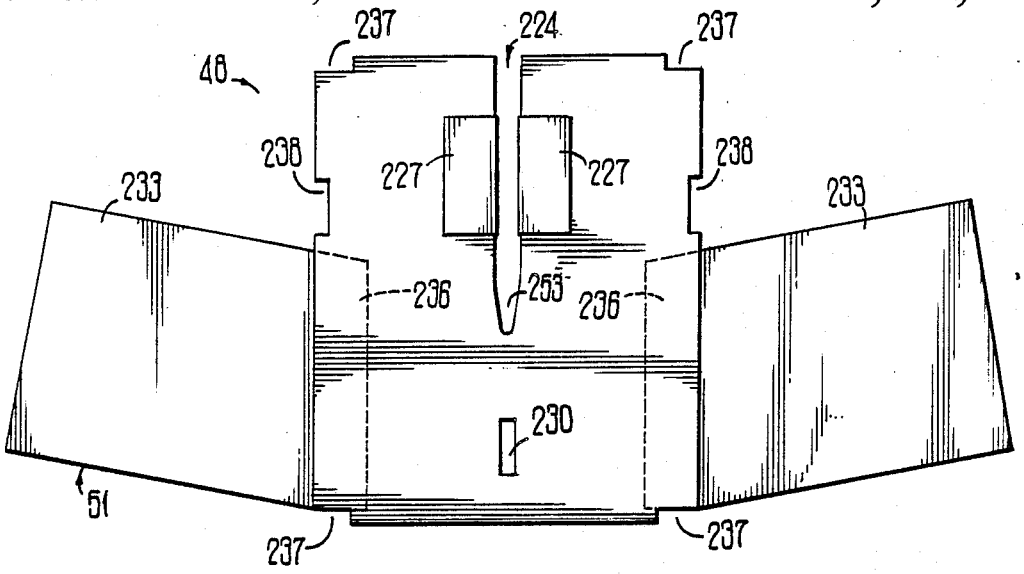
FIG. 7 is a top plan view of a gear case pad according to the present invention.

FIG. 7 illustrates a top plan view of the gear case pad 48 of the present invention. A longitudinal slot 224 extends from the front edge of the pad 48 towards the latitudinal axis of the pad 48. The length and width of the slot 224 depends on the width of the gear case housing and the orientation of the motor in the container 10. An abrasion pad 227 overlaps a portion of the longitudinal edge of the slot 224 and foldably connects to the upper and lower surfaces of the pad 48. A rectangular opening 230 to receive the motor trim tab (better illustrated in FIG. 1) is placed along the longitudinal axis in the latitudinally lower portion of the pad 48. The pad 48 includes a pair of wings 51 each with a foldably extendable side 233 which connects by a flap 236 to the lower surface of the pad 48. Each corner of the pad 48 defines a notched cut-out 237. Adjacent the wing 51 on each side of the pad 48 is a notched cut-out 238.

Figure 8:
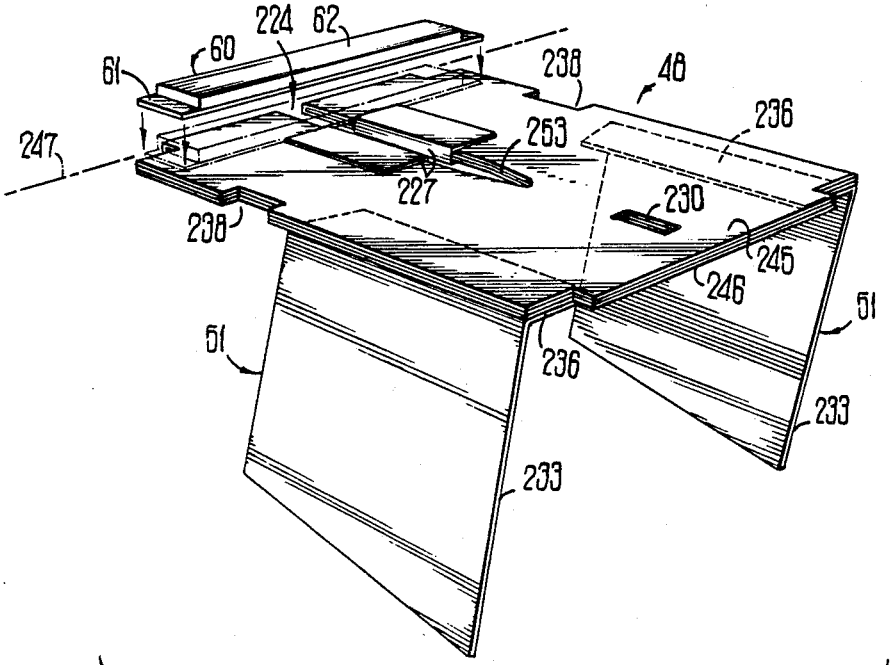
FIG. 8 is a perspective view of the gear case pad as shown in FIG. 7, illustrating the side wings folded down for installation adjacent a motor frame in an outboard motor pack assembly such as that illustrated in FIG. 1, and also illustrating an upper gear case pad according to the present invention that attaches to the upper surface of the gear case pad adjacent the gear case housing.

FIG. 8 is a perspective view of the gear case pad 48 with the wings 51 foldably extended downward in a manner in which the wings 51 would be positioned against the side rail 36 of the motor frame 33. FIG. 8 also illustrates in perspective view the upper gear case support pad 60 which in a preferred embodiment is made from a composite of a rectangular longitudinally extended corrugated paperboard member 61 glued and stapled to a wood slat 62. The upper gear case support pad 60 mounts to the upper surface of the gear case pad 48 between the front notch corner 237 and the side notch 238. The edge of the pad 60 abuts the edge of motor gear case housing and the inside edge of the notch 237. Thus, the pad 60 straddles the slot 224 and closes longitudinal passage through the slot 224.

The exterior elements of the gear case pad 48 illustrated in FIG. 8 in a preferred embodiment may be made from a corrugated paperboard blank. As may be appreciated by those of skill in the art, the blank includes two panels 245 and 246 which foldably hinge together along the latitudinal axis 247. In a preferred embodiment, the axis 247 is of a width sufficient to permit the panels 245 and 246 to fold and wrap around an inner horizontal pad. In one embodiment the inner pad is made of a hardwood veneer. The slot 224 is defined in the blank by a longitudinally extending opening having tapered ends which define the interior end 253 of the slot 224.

Figure 6A:
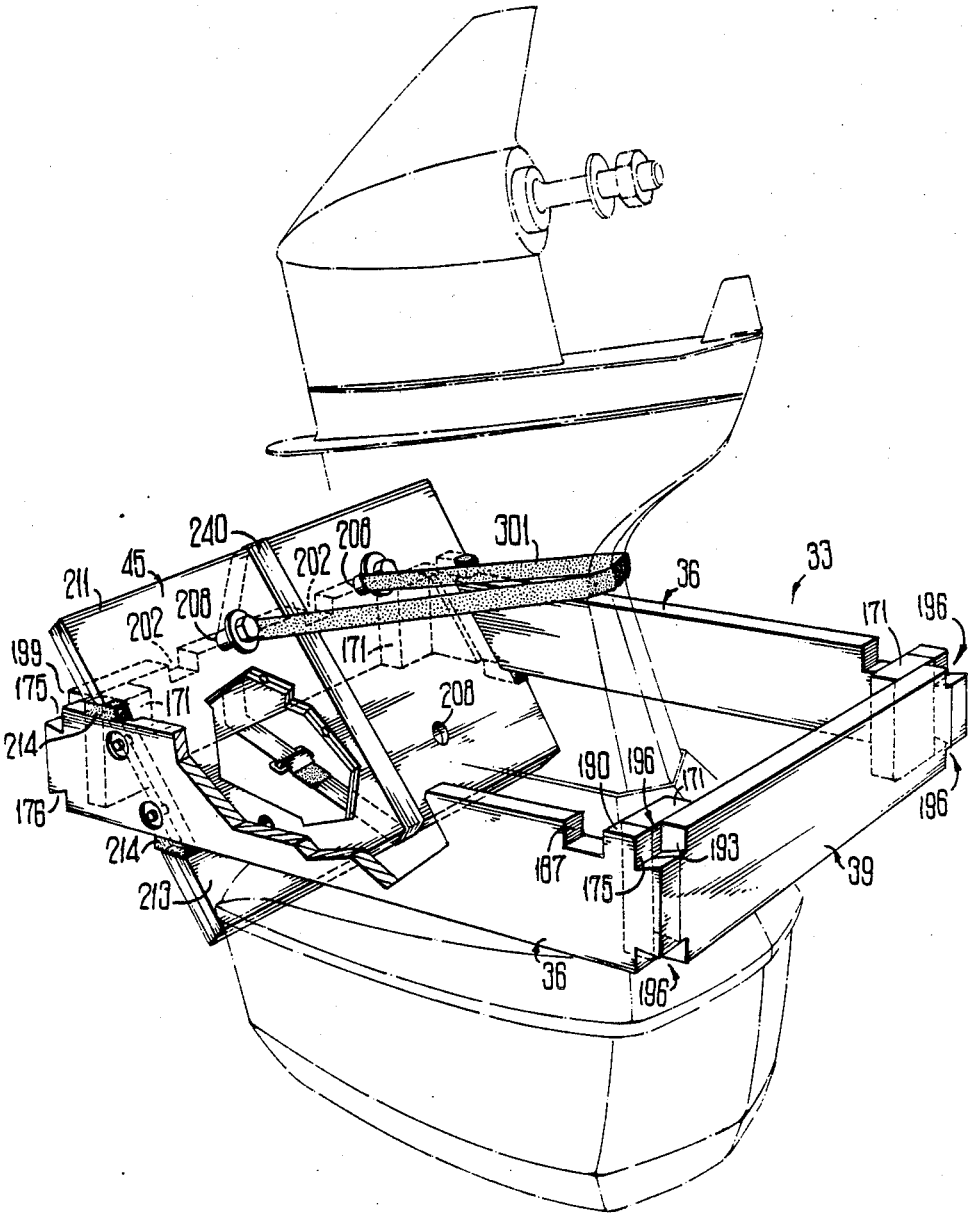
FIG. 6A is a perspective view of a motor frame with a gear case strap and a crossbar/front rail strap according to the preferred invention.

An alternate embodiment of the present invention eliminates the upper gear case pad support 60. Instead, as illustrated in FIG. 6A, a tension strap 240 wraps tightly around the front rail 42 and the crossbar 45. The crossbar/front rail strap 240 prevents the crossbar 45 from twisting or rotating out of the grooves 178 in the side rails 36. Such twisting or rotating generally occurs in the event of a powerhead drop of a motor container. With the motor rigidly mounted to the crossbar 45 and forced against its stern bracket, the force acting on the crossbar 45 from a drop or tipover deforms the crossbar 45. This twists or rotates the crossbar 45 out of the grooves 178 and permits the motor to pivot around the crossbar 45. The strap 240 thus prevents the crossbar 45 from deforming in response to a shock force and because the motor cannot pivot, use of the crossbar/front rail strap 240 eliminates the need to install the upper gear case pad support 60. This reduces the parts cost and labor time for assembling the container and packing the motor on the motor assembly line. In a preferred embodiment, the strap 240 is made from ¾ inch × 0.031 inch steel banding, and the ends are rigidly connected with a clip or self-crimping connector.

Figure 9:
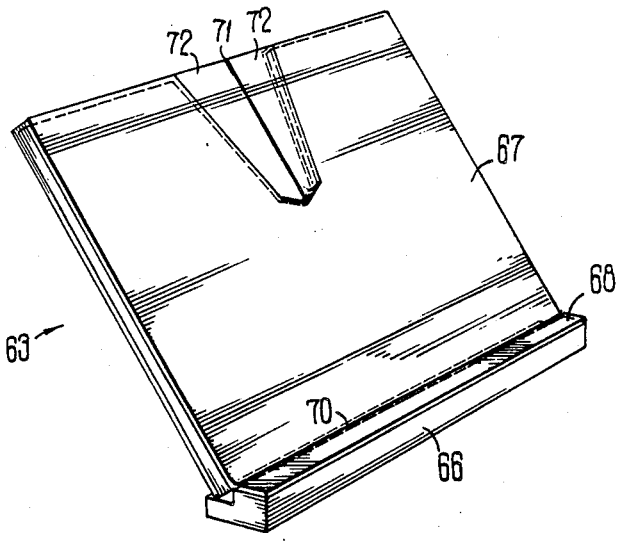
FIG. 9 is an perspective view of the exhaust housing pad according to the present invention.

The exhaust housing pad 63 of the present invention is illustrated in perspective view in FIG. 9. A support member 66 connects to a pad 67 along a narrow flange 68 extending from the pad 67 along a score line 70. The support member 66 in cross section is L-shaped. A slot 71 extends along the latitudinal axis of the pad 67 from the upper edge towards the longitudinal axis. Adjacent the slot 71 are a pair of foldably connected flaps 72.

The exhaust housing pad 63 in a preferred embodiment is constructed from two exterior layers of corrugated paper board sheets laminated to a wood veneer filler sheet. Such component construction provides adequate restraint of the motor with sufficient yield or cushioning to reduce or eliminate damage to the motor if dropped or tipped over.

The exhaust housing pad 63 resists rotational movement of the motor which is pulled by gravity to pivot around its stern bracket and thus force the gear case housing and propellor through the sides of the container 10. The pad 63 is necessary because the motor is mounted powerhead down at an angle with respect to the motor frame 33. The motor is thus at an angle with respect to the true vertical and is in a full down or non-tilted position with respect to the crossbar 45. The motor is kept in the full non-tilted position by hydraulic fluid pressure in the motor tilt cylinders. The hydraulic fluid however tends to leak back to the tilt fluid reservoir in the motor after the motor has been left in the upside down powerhead down position for a period. (The tilt cylinders generally do not leak when the motor is mounted in a normal powerhead up position on a boat). Once the hydraulic fluid returns to the reservoir, the pressure in the tilt cylinders is reduced. The motor then can pivot easily about the stern bracket, and because the motor is mounted in the frame 33 at an angle to minimize the package cube for freight considerations, the powerhead will seek a vertical position, unless otherwise restrained. It is contemplated that extreme mishandling, or even normal truck shipment with long the periods of bouncing and shaking that generally occurs, would crush corrugated padding and allow the motor to swing to a vertical position under the force of gravity. This results in the prop shaft coming through the sides of the box and the powerhead hitting the bottom of the box. This not only damages the packing container but exposes the motor to damage as well. The exhaust housing pad 63 thus prevents such movement by the motor because the slot 71 engages the gear case housing and together with the foldable flaps 72 restricts movement of the motor through the sides of container 10.

An embodiment of the present invention for shipping smaller 2 and 3 cylinder motors may use a two-ply corrugated exhaust housing pad, but preferred embodiments for the larger 4, 6 or 8 cylinder motors use the corrugated paperboard-wood veneer structure to keep the motor tilted in the container 10 when the hydraulic fluid has leaked back to the reservoir. The composite structure provides sufficient rigidity yet adequate flexibility to restrain the motor without damage if the package is dropped or tipped over.

FIG. 6A illustrates an alternate embodiment of the present invention. The ends of a strap 301 attach to the crossbar 45 and the strap 301 wraps around the gearcase housing of the motor. The gearcase strap 301 replaces the exhaust housing pad 63, and in a container for lighter-weight motors, restrains the movement of the motor if the container is dropped or tipped over, yet provides flexibility to dampen the shocks received by the package from mishandling. This gearcase strap 301 may be made from a variety of materials including metal, plastic with longitudinal reinforcing threads, or woven fabric. It is preferred that a woven fabric be used. The ends of the strap 301 may terminate in metal rings. The strap 301 is positioned around the gear case housing, with the rings secured to the motor mounting bolts which extend through the mounting holes 208 of the crossbar 45. The gearcase strap 301 holds the motor in its upright position yet provides adequate flexibility to restrain lateral and forward rotational movement of the motor if the motor container is dropped or tipped over.

Figure 10:
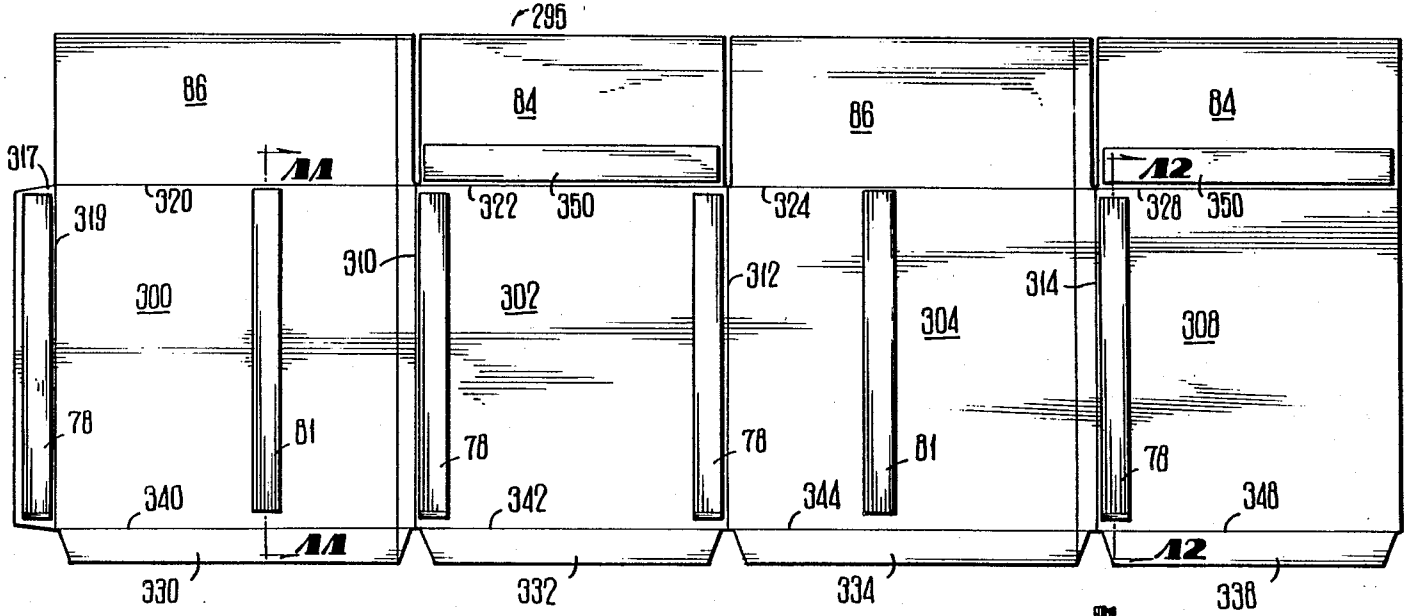
FIG. 10 is a top plan view of the top box blank, which, when assembled, encloses the gear drive housing and propeller mounting shaft of the outboard motor as illustrated in FIG. 1.

FIG. 10 is a top plan view of the unfolded top box 72 which, when assembled, encloses the gear drive housing and propellor mounting shaft of the outboard motor supported and contained within the packaging 10 of the present invention. As illustrated, the top box 72 of the present invention is preferably formed from a blank of corrugated paper board material. The blank 295 includes four panels, 300, 302, 304 and 308 foldably connected along score lines 310, 312 and 314 respectively. The four main panels 300, 302, 304 and 308 form the four sidewalls of the top box 72 as illustrated in FIG. 1. A joint tab 317 foldably connects to the blank 295 along score line 319 adjacent the side panel 300. A pair of outer flaps 86 foldably connect along score line 320 to the side panel 300 and along score line 324 to the side panel 304. Similarly, a pair of inner flaps 84 connect along a score line 322 to the side panel 302 and along a score line 328 to the side panel 308. The bottom edges of the four panels 300, 302, 304 and 308 define tapered connector flanges 330, 332, 334 and 338. The flanges 330, 332, 334 and 338 fold along the score lines 340, 342, 344 and 348. A corner cleat 78 is securely fixed to the interior surface of the corrugated paper board blank 295 adjacent each score line 310, 312, 314 and 319. A pair of side cleats 81 are also securely fixed to the interior surface of the blank 295. One cleat 81 mounts to the panel 300 while a second cleat 81 mounts to the panel 304. Each of the inner flaps 84 include a top support member 305 adjacent the score lines 322 and 328. The cleats 78 and 81 and the support members 350 attach to the paperboard with a combination of glue and staples.

Figure 11:
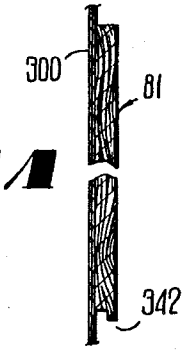
FIG. 11 is a cross section detailed illustration of the side cleat mounted to the inside wall of the top box illustrated in FIG. 10, taken along lines 11—11 of FIG. 10.

Turning now to FIG. 11, there is a detailed cross-section illustration taken along lines 11—11 of FIG. 10 showing the side cleat 81 mounted to the inside wall of the top box 72. The lower end 342 of the side cleat 81 is notched to define a longitudinal extending flange 342. The flange 342 engages the mortise **184*a* in the upper surface of the side rail 36 of the motor mounting frame 33 as illustrated in FIG. 6. While positioning the top box 72 over the motor mount frame 33, it may be difficult to insert the flange 342 in the mortise 184*a*. An alternate embodiment therefore squares off the lower end of the side cleat 81 eliminates the mortise 184*a* in the side rails 36. The side cleat 81 contacts the top surface of the side rail 36**.

Figure 12:
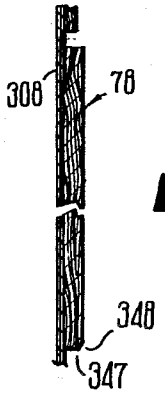
FIG. 12 is a cross section view of the vertical corner cleat of the top box illustrated in FIG. 10, taken along lines 12—12 of FIG. 10.

FIG. 12 illustrates a detailed cross-section of the corner cleat 78 taken along lines 12—12 of FIG. 10. The lower end of the cleat 78 has a upwardly beveled end 347. The bevel is about 7 degrees with respect to the horizontal. In addition, the interior face of the cleat 78 is tapered to define an ease 348. The ease 348 and the tapered end 347 of the corner cleat 78 engage the upper corner pocket 193 of the motor mounting frame 33.

The present invention therefore provides a packing container 10 having a minimum number of components as illustrated in FIG. 1 with an alternate embodiment of the motor frame 33 illustrated in FIG. 6A. The fewer and more compact components of the present invention reduce inventory storage and control problems, and structure of the present invention provides a strong container for securely yet flexibly retaining an outboard motor in the container 10 and for protecting the motor from damage during shipment and warehose storage. For instance, manufacture of the motor frame 33 with the crossbar/front rail strap 240 eliminates the need to inventory the upper gear case pad 60.

The assembled outboard motor mounts in the shipping container 10 in a powerhead down position. An assembled outboard motor ready for packing is raised powerhead down with a hoist. The bolts extending from the motor mounting bracket on the motor insert through rubber bushings installed in the bores 208 of the crossbar 45 which mounts in the motor frame 33. If used, the gear case strap 301 wraps around the gear case housing of the motor and is secured to the crossbar 45. Appropriate washers and nuts threaded onto the motor mounting bolts securely mount the motor to the crossbar 45. The shank of an air operated wrench extends through the slot 202 to tighten the nut which threads on the motor mounting bolt.

The bottom box 16 is squared open and placed with the flanges 134, 136, 138 and 140 down. The flaps 28 and 31 fold back and the assembled bottom frame 13 inserts into the end of the bottom box 16. The beveled ends 174 of the longitudinal support member 166 engage the beveled lower ends 152 of the corner cleats 19. The flange leg 164 at the lower end of the side cleat 22 engages the mortise 169 of the longitudinal support member 166. The pair of flaps 28 and the pair of flaps 31 fold along the score lines 128, 129, 130 and 131 to position the flaps 28 and 31 perpendicular to the side panels of the bottom box 16 and cover the bottom frame 13. In a preferred embodiment, the flaps 28 and 31 may be glued together and stapled to the frame 13 with an air staple gun of common usage in industry or crimp style staples could be used. The box 16 is inverted to place the bottom frame 13 down.

The outboard motor mounted in the motor frame assembly 33 is then raised by the hoist and lowered into the upright bottom box 16 with the bottom frame 13 and the flaps 28 and 31 adjacent the floor. The flange leg 162 of the side cleats 22 engages the lower mortise 184 in the lower surface of the motor frame side rails 36. The ease or tapered upper end 159 of the corner cleats 19 eases the entry of the cleat 19 into the lower pockets 196 defined by the notches 176, 193 and 199 in the side, rear, and front rails respectively of the motor frame 33. The beveled upper end 156 of the cleat 19 mates with the beveled notches in the pockets 196 to lock the vertical cleats 19 of the box 16 and the motor frame assembly 33 together.

The exhaust housing pad 63 may then be installed on the motor frame 33. The ends of the support member 66 insert into the notches 187 of the side rails 36 against the stop 190. Nails driven through the ends of the support member 66 into the motor frame side rails 36 rigidly connect the pad 63 to the motor frame 33. The upper surface of the exhaust housing pad 63 pushes against and supports the exhaust housing of the outboard motor being packed in the container 10. The exhaust housing pad 63 in an alternate embodiment is not used, but as noted above, the gearcase strap 301, with its ends connected to the crossbar 45, wraps around the gear case housing.

The gear case housing pad 48 is installed next. The gear case pad 48 is installed by placing the slot 224 around the gear case such that the opening 230 is over the trim tab of the outboard motor. Thus, the gear case pad rests atop the cavitation plate and surrounds the gear case. Pushing the pad 48 laterally with respect to the motor gear case positions the gear case on the pads 227 and permits the gear case of the motor to slidably seat in the slot 224. The side wings 51 unfold and are pushed down adjacent the side rails 36 between the interior walls of the bottom box 16 and the exterior face of the side rails. The side wings are rigidly secured to the side rails 36 with staples from an air staple gun common in the industry.

With the gear case of the outboard motor seated in the slot 224, the upper gear case support pad 60 is rigidly secured with glue and staples to the top of the gear case pad 48 adjacent the motor gear case. (For embodiments using the motor frame crossbar/front rail strap 240, the upper gear case pad 60 may not need to be installed.) This support pad 60 rigidly fixed to the pad 48 prevents the motor gear case from rotating back through the longitudinal main slot 224 in the event the motor is shipped or handled in a powerhead up position. This sometimes happens during shipment if the motor is tipped over accidentally and then stood up. Due to the angle that the motor is mounted with respect to the vertical (i.e., the crossbar 45 angle), a reverse pivoting effect due to gravity will occur if the motor is then shipped with the powerhead up. It is contemplated that the upper gear case support pad 60 prevents motor and package damage as the motor is caused by gravity to attempt to reverse out of the gear case slot 224. The force of the reversal places stress on the crossbar 45. If the upper gear case pad 60 is not rigidly in place, a subsequent drop with the motor in the powerhead up position may shear the crossbar 45 and result in damage to the shipped outboard motor. As noted above, an alternate embodiment eliminates the upper gear case pad 60 by using a tension strap 240 tightly wrapped around the front rail 42 and the crossbar 45. The strap prevents the crossbar 45 from deforming in response to a shock force and thus permitting the crossbar to twist or rotate out of the grooves 178. Generally, the strap 240 is already installed on the motor mount frame 33 when received from the container manufacturer.

The top box 72 is squared open and placed over the upwardly extended gear case end of the motor. The top box 72 is pushed down until the cleats 78 and 81 on the interior surface of the top box 72 lock into the mating notches 196 and mortises **184*a* in the upper surfaces of the side and end rails of the motor frame 33**.

The flange areas 330, 332, 334 and 338 of the top box 72 mate with and overlap the flange areas 134, 136, 138 and 140 of the bottom box 16. These flange areas are preferably crushed to reduce the wall bulk when overlapped. These areas are rigidly secured together. In a preferred embodiment, glue may be applied to the overlap area of the flanges and air gun staples are placed through both overlap flanges into the motor frame 33. It is preferred that these staples be driven five or six inches apart. It is contemplated that the glue and staple joint bonds both the top box 72 and the bottom box 16 of the shipping carton 10 together to make an integral box and thus locks the motor frame 33 rigidly between the lower box and upper box vertical cleats.

Motor accessories such as the propellor, external gas tank, control cables, and the like may be boxed and packed on the gear case pad 54 by inserting the accessories boxes through the opened flaps 84 and 86 of the top box 72. These flaps are then closed by folding along the scored line 320, 322, 324 and 328. The flaps 84 and 86 may be stapled into the top boards 350 or alternately glued and crimp stapled as desired. The top support members 350 lay across the upper ends of the corner cleats 78 to form a framework reinforcing the top flaps 84 and 86. This upper framework enables the packaged motors to be more easily and safely stacked in a warehouse. The members 350 effectively increase the stacking surface area and thus reduce the need for precise stacking as would be required if the support members 350 were not used.

In an alternate embodiment, the strips 350 are eliminated from the top box 72 and a support frame similar to the support frame 13 is inserted at the upper end of the top box 72. The upper ends of the cleats 78 and 81 in this embodiment may be beveled or notched in a manner similar to the lower ends of the cleats 19 and 22, respectively, in the lower box 16. The use of a support frame 13 in the upper box allows smaller packages to be placed on top of the container as may happen in less-than-truckload shipments by common carrier motor freight lines. These smaller packs could be of a size or weight that would not be adequately supported by the strips 350 and flaps 84 and 86, and the packs may fall through the container and damage the skeg of the outboard motor. Further, the use of the support frame 13 in the top box 72 protects the motor and allows for forklift handling in the event that the container is accidentally placed in the powerhead up position. This sometimes occurs inadvertently during handling when the container is tipped over and then righted with the container upside down.

The present invention thus suspends the outboard motor in a box 10 powerhead down with clearance on the sides, top and bottom. The powerhead down position lowers the center of gravity for the container 10. The container 10 provides adequate rigidity and restraint to securely hold the motor during shipping yet provides sufficient cushioning to absorb shock which may occur during shipping.

The motor frame 33 of the present invention provides corner pockets 196 that accept the ends of vertical cleats 19 and 78 in the bottom and top boxes 16 and 72. In a preferred embodiment, these pockets 196 are essentially the width and thickness of the corner vertical cleats 19 and 78 plus an allowance for tolerance variation and ease of fit. The side rails 36 and end rails 39 and 42 of the motor frame include end notches such that when the frame is assembled, the pocket 196 defined by the notches in ends of the rails has a slight inward beveled angle. It is contemplated that in the event of a vertical drop, the beveled angle forces the cleats 19 and 78 into the pockets 196 in the motor frame 33 instead of forcing the cleats 19 and 78 outward as may occur without this inward bevel. Such an outward movement of the vertical cleats 19 and 78 could cause the motor frame 33 to slip off the cleats 19 and 78 and fall with the weight of the motor and thus damage both the motor and the container 10. It is contemplated that if the bevel angle is too great, the vertical cleat 19 and 78 will shear and split the pocket 196. The four corner blocks 171 in the motor frame 33 further serve to both form the rear of the pocket 196 as well as provide a nailing block to better secure the side rails 36 and the end rails 39 and 42 rigidly together.

The mortise pockets 184 and **184*a* routed in the upper and lower surfaces of the side rails 36 accept the leg 162 or 342 on the ends of the box side panes cleats 22 and 81. This connection of the vertical cleats 22 and 81 to the side rails 36 of the motor frame 33 helps keep the top and bottom boxes 16 and 72 connected together. In particular, this joint prevents the cleats 22 and 81 from slipping out from under the rails 36 on the motor frame 33**.

The extension wings 51 on the gear case pad 48 are secured to the side rails 36 of the motor frame during packaging. It is preferred that the wings 51 be stapled to the motor frame 33. This connection stabilizes the gear case pad 48 and keeps it in an essentially horizontal plane across the width of the container 10. The gear case pad 48 also helps maintain the tilt angle resulting from mounting the motor on the crossbar 45 in the motor frame 33.

The gear case pad 48 in a preferred embodiment is a composite formed from a wooden veneer sandwiched between layers of corrugated paperboard. The gear case pad 48 placed over the motor cavitation plate is slotted to fit around the lower gear case. The slot 224 roughly matches the width and shape of the gear case and so restrains the motor from lateral movement as well as forward movement as the tilt fluid in the motor leaks back into its reservoir and the powerhead attempts to rotate to a vertical position under the force of gravity The gear case pad 48 also cooperates with the exhaust housing pad 63 to restrain lateral movement of the motor in cases of extreme mishandling. In a preferred embodiment, the composite gear case pad 48 is of balanced strength such that the pad will yield but not break to absorb the forces incurred during rough handling, tipping or falling. It is contemplated that if the gear case pad 48 is not strong enough, the motor may rotate and the powerhead hit the inside of the container 10 and thus hit the floor or ground on which the container 10 rests, perhaps breaking the fiberglass motor cover and causing other major engine damage. On the other hand, if the gear case pad 48 is too stiff, as would be the case if the pad were entirely plywood or a heavier material, the pad 48 will not yield and the adaptor casting of the motor may crack. An alternative embodiment uses a strap 301 fixed to the crossbar 45 and looped over the gear case housing to cooperate with the gear case pad 48 to restrain lateral movement of the motor.

For smaller, lighter motors, an alternative embodiment of the gear case pad may be constructed without the wood veneer sheet sandwiched between the paperboard sheets and thus save cost and weight.

In a preferred embodiment, the gear case pad 48 is notched in the corners 237 and on each side 238 to mate with the vertical wood cleats 78 and 81 of the upper box. The notches 237 and 238 in the gear case 48 pad allow the vertical cleats 78 and 81 of the upper box to pass by and nest adjacent the gear case pad 48. Thus the gear case pad 48 contacts the vertical cleats 78 and 81 in the box top 72 to provide additional lateral support for the cleats 78 and 81 in the event of a tipover as well as support for clamp or squeeze truck handling.

In a preferred embodiment using the comprise gear case pad 48, the slot 224 in the veneer filler is cut deeper toward the closed end of the slot 224 than the corrugated outer sheets which are laminated to it. The corrugated outer sheets thus define a lip extending into the slot 224. It is contemplated the corrugated lip provides a cushioning effect for the motor in the event it is dropped during shipping. The gear case first crushes the outer corrugated sheets and thus its movement is slowed and cushioned. The center wood veneer sheet crushes more slowly and thus will gradually yield to stop the motor. This prevents the propellor shaft from coming through the front of the box and prevents the powerhead from hitting the bottom of the box. Thus, the preferred embodiment of the present invention provides a shock absorbing function in the event the motor and container 10 are dropped. Such shock absorbing capacity reduces the risk that too rapid or too rigid a stop will cause cracking of the adaptor casting through which the engine is bolted to the gear case and stern bracket.

When the container 10 is assembled, the exhaust pad support brace 66 is nailed at each end into the side rails 36. The pad 67 is forced inwardly under the cavitation plate and the curved area where the gear case meets the propellor shaft housing of the motor. The force of gravity, tending to rotate the motor to vertical, thus locks the pad 63 in place between the motor and the motor frame 33. The gear case housing adjacent the cavitation plate slidably enters the slot 71. The slot 71 and the flaps 72, together with the pad 67, keep the motor from swiveling side-to-side. In one embodiment for heavy motors, a metal brace may be attached from the tiller arm of the motor where the steering cables attach to a stationary part of the stern bracket. The brace assists the exhaust housing pad 63 to prevent swiveling in cases of extreme mishandling such as a powerhead up tip over.

Figure 2A:
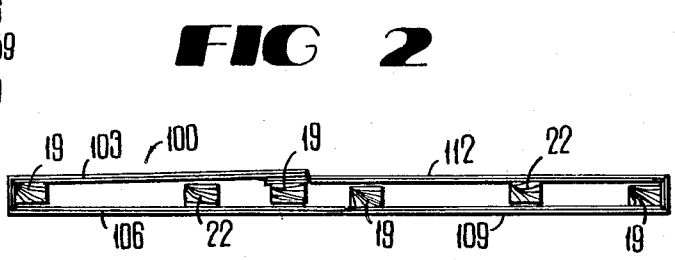
FIG. 2A is a top view of the bottom box blank illustrated in FIG. 2 assembled and collapsed to a compact size.

The components of the package 10 knock down to minimize storage space and inbound freight costs. For instance, FIG. 2A illustrates a top view of the bottom box blank 16 assembled and collapsed to a compact size. The seven components reduce inventory and control problems and simplify the packing operation on the motor manufacturing assembly line.

Figure 13:
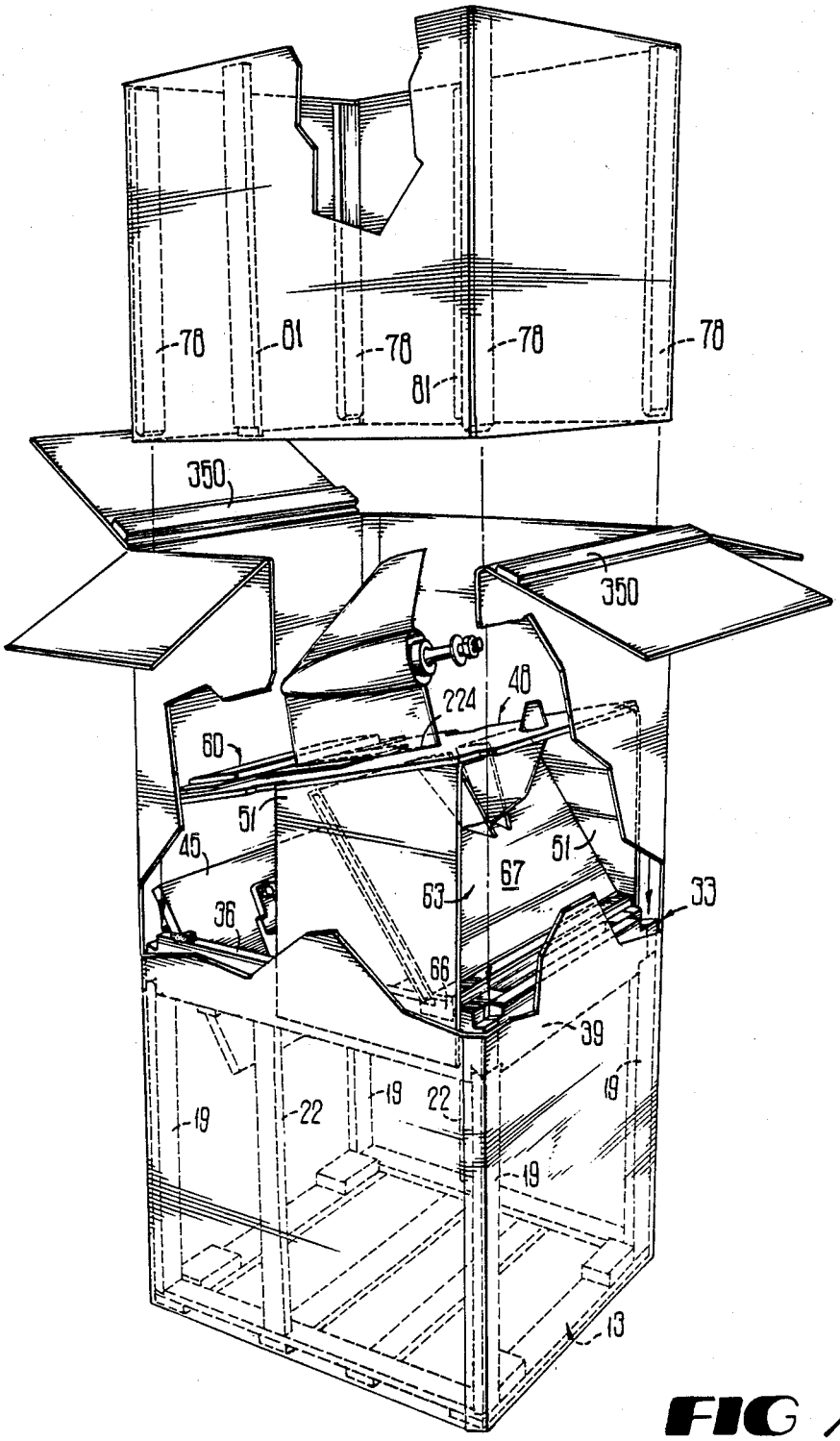
FIG. 13 is an exploded perspective view of an alternate embodiment of the present invention.

An alternate embodiment of the present invention illustrated in FIG. 13 replaces the bottom box 16 and the top box 72 with a single longitudinal box. That box includes the lower cleats 19 and 22, and the bottom frame 13 connects at the lower end of the box. The motor, bolted to the motor frame 33, is lowered by a hoist onto the upper end of the cleats 19 and 22. A paperboard sleeve which includes the upper cleats 78 and 81 and the gear case pad 48 slides down into the box and contacts with the upper edge of the motor mount frame 33. This embodiment, however, may not be as satisfactory as the preferred embodiment, and may afford less protection to the contained motor.

The principles, preferred embodiments and modes of operation of the present invention have been described in the foregoing specification. The invention is not to be construed as limited to the particular forms disclosed because these are regarded as illustrative rather than restrictive. Moreover, variations and changes may be made by those skilled in the art without departing from the spirit of the invention as described by the following claims.

What is claimed is:

1. A container for supporting an outboard motor, comprising:

a bottom box to enclose the powerhead end of the motor;

a motor mount frame, comprising:

a pair of side rails;

a crossbar on which the motor mounts, the crossbar connected normal to the side rails;

means for maintaining the side rails in parallel relation; and at least one resilient bushing disposed between the connections of the crossbar and each side rail;

means for resisting rotational movement by the motor with respect to the motor mount frame;

a top box to enclose the gear case end of the motor; and means for connecting the top box of the bottom box.

2. A container for supporting an outboard motor, comprising:

a bottom box to enclosed the powerhead end of the motor;

a motor mount frame, comprising:

a pair of side rails, with at least one bore in each side rail transverse to the longitudinal axis of the side rail;

a crossbar on which the motor mounts, the crossbar connected normal to the side rails and having at least one bore through the crossbar parallel to the longitudinal axis of the crossbar;

a threaded rod disposed in the crossbar bore and extending through the side rail bores;

a nut engaging each end of the threaded rod of the exterior side of the bore, the nuts tightened to connect rigidly the crossbar and the side rails; and means for maintaining the side rails in parallel relation;

means for resisting rotational movement by the motor with respect to the motor mount frame;

a top box to enclose the gear case end of the motor; and means for connecting the top box to the bottom box.

3. A container for supporting an outboard motor, comprising:

a bottom box to enclose the powerhead end of the motor;

means for supporting the motor in a powerhead down position a gear case pad having a slot to accept the gear case housing of the motor;

an upper gear case pad closing the slot;

an exhaust housing pad for positioning against the exhaust housing of the motor;

a top box to enclose the gear case end of the motor; and means for connecting the top box to the bottom box.

4. A motor mount frame for supporting an outboard motor in a container during shipment, comprising:

a pair of side rails;

a crossbar mounted to the side rails at an angle with respect to a longitudinal axis of the container for orienting the motor at an angle with respect to the longitudinal axis of the container;

at least one resilient bushing disposed between the crossbar and each side rail; and means for maintaining the side rails in a fixed spaced relation.

5. A motor mount frame for supporting an outboard motor in a container during shipment, comprising:

a pair of side rails with at least one bore in each side rail transverse to the longitudinal axis of the side rail;

A crossbar mounted to the side rails at an angle with respect to a longitudinal axis of the container for orienting the motor at an angle with respect to the longitudinal axis of the container;

at least one transverse bore in the crossbar;

a threaded rod disposed in the crossbar bore and extending through the bores in the side rails;

a nut tightened at each end of the rod to connect rigidly the crossbar and the side rails; and means for maintaining the side rails in a fixed spaced relation.

6. The container as recited in claim 2, wherein the side rail bores are countersunk.

7. The container as recited in claim 2 , comprising a resilient bushing in the side rail bore.

8. The motor mount frame as recited in claim 5, wherein the side rail bore is countersunk.

9. The motor mount frame as recited in claim 5 further comprising a resilient bushing in the side rail bore.

10. A container for an outboard motor, comprising:

a longitudinal box having a plurality of cleats on the interior sides of the box, the cleats extending upwardly from the bottom;

a motor frame supported on the upper ends of the cleats; and a sleeve slidably disposed in the upper end of the box to contact the motor frame.

11. The container as recited in claim 10, further comprising a support frame connected to the bottom of the box.

12. The container as recited in claim 10, wherein the sleeve has a plurality of interior side wall cleats.

13. The container as recited in claim 10, wherein the motor frame further comprises a crossbar on which the motor connects, the crossbar mounted in the frame at an angle sufficient to orient the motor at an angle with respect to vertical.

14. The container as recited in claim 10, further comprising a gear case pad.

15. The container as recited in claim 14, wherein the gear case pad has a pair of depending side wings which connect the gear case pad to the motor mount frame.

16. The container as recited in claim 14, wherein the gear case pad includes a slot sized to receive the gear case housing of the motor.

17. The container as recited in claim 10, further comprising means for resisting rotational movement of the motor.

18. The container as recited in claim 17, wherein the means for resisting rotational movement comprises a strap connected at its ends to the motor frame.

19. The container as recited in claim 17, wherein the means for resisting rotational movement comprises at least one pad positioned between the motor and the box.

20. The container as recited in claim 10, wherein the motor frame comprises:

a pair of side rails;

a crossbar mounted at an angle sufficient to orient a motor at an angle with respect to vertical; and means for maintaining the side rails parallel.

21. The container as recited in claim 20, wherein the means for maintaining the side rails parallel further comprises:

a front rail connected normal to the side rails; and a rear rail connected normal to the side rails.

22. The container as recited in claim 21 further comprising means for resisting forward rotational movement of the motor.

23. The container as recited in claim 22, wherein the means for resisting forward rotational movement comprises a pad positioned between the motor and the box.

24. The container as recited in claim 22, wherein the means for resisting forward rotational movement comprises a strap positioned around the front rail and the crossbar.

25. The container as recited in claim 20, further comprising a strap connected at its ends to the crossbar.

* * * * *